United States Patent [19]

Kaku et al.

[11] Patent Number: 4,662,267

[45] Date of Patent: May 5, 1987

[54] SWASH PLATE TYPE COMPRESSOR SHOE

[75] Inventors: Yoshihiro Kaku; Keiichiro Otsu, both of Toyota, Japan

[73] Assignees: Kabushiki Kaisha Toyoda Jidoshokki Seisakusho, Kariya; Taiho Kogyo Co., Ltd., Toyota, both of Japan

[21] Appl. No.: 699,109

[22] Filed: Feb. 7, 1985

Related U.S. Application Data

[62] Division of Ser. No. 328,547, Nov. 27, 1981, filed as PCT JP8100067 Mar. 28, 1981, published as WO81/02767 on Oct. 1, 1981, Pat. No. 4,512,175.

[30] Foreign Application Priority Data

| | | | |
|---|---|---|---|
| Mar. 28, 1980 | [JP] | Japan | 55-39842 |
| Mar. 31, 1980 | [JP] | Japan | 55-41387 |
| Mar. 31, 1980 | [JP] | Japan | 55-41388 |
| Oct. 29, 1980 | [JP] | Japan | 55-151907 |

[51] Int. Cl.[4] ..... F01B 3/00; F04B 1/12

[52] U.S. Cl. ..... 92/71; 417/269; 74/60

[58] Field of Search ..... 417/269; 91/488, 499; 74/60; 92/71, 72

[56] References Cited

U.S. PATENT DOCUMENTS

| | | | |
|---|---|---|---|
| 2,980,077 | 4/1961 | Magill | 91/488 |
| 3,006,324 | 10/1961 | Shaw | 184/6.17 |
| 3,521,532 | 7/1970 | Espig et al. | 91/499 |
| 3,996,806 | 12/1976 | Alexander | 74/60 |
| 4,037,522 | 7/1977 | Inoshita | 92/72 |
| 4,244,679 | 1/1981 | Nakayama | 92/71 |
| 4,285,640 | 8/1981 | Mukai | 417/269 |
| 4,420,986 | 12/1983 | Nakayama | 74/60 |
| 4,470,761 | 9/1984 | Mukai | 417/269 |

FOREIGN PATENT DOCUMENTS

| | | | |
|---|---|---|---|
| 47903 | 3/1979 | Japan | 417/269 |
| 47912 | 12/1979 | Japan | 417/269 |
| 48110 | 10/1981 | Japan | 74/60 |
| 48205 | 5/1982 | Japan | 74/60 |

*Primary Examiner*—Carlton R. Croyle
*Assistant Examiner*—Paul F. Neils
*Attorney, Agent, or Firm*—Flynn, Thiel, Boutell & Tanis

[57] ABSTRACT

There are disclosed a shoe which is interposed between a swash plate and a piston of a swash plate type compressor and which converts rotary movement of the swash plate into reciprocal movement of the piston, and a method for manufacturing the same. The shoe has a hemispherical part which is in slidable contact with the surface of a piston defining a hemispherical recess, and a flat end face which is in slidable contact with a bottom end face of the swash plate. According to the method of the invention, a columnar element is compressed in the axial direction for plastic deformation in such a manner that one end of the columnar element is deformed along the inner surface of a hemispherical recess of a die while the other end is urged against the flat end surface of another die. A shoe can be easily manufactured with this method, which has a flank between the hemispherical part which is in slidable contact with the surface of the piston defining the hemispherical recess and the bottom end face of the swash plate which is in slidable contact with the swash plate. According to this method, a hole of a predetermined size may alternatively be formed at the end face of a columnar part of the element, and the end face of the columnar part is cut into a conical shape while reducing the diameter of the hole toward the opening side thereof. Still alternatively, the periphery of the end face of the columnar part may be cut into a conical shape and then pressed to form a hemispherical part. A great flow of the material and local exertion of a high load on the element are prevented.

13 Claims, 9 Drawing Figures

SWASH PLATE TYPE COMPRESSOR SHOE

This is a division of application Ser. No. 328,547 filed Nov. 27, 1981, as PCT JP 8100067 Mar. 28, 1981, published as WO 81/02767 on Oct. 1, 1981, now U.S. Pat. No. 4,512,175.

TECHNICAL FIELD

The present invention relates to a swash plate type compressor shoe and a method for manufacturing the same. More particularly, the present invention relates to a swash plate type compressor shoe which is interposed between a swash plate rotated by a rotating shaft in a cylinder block and a piston slidably fitted inside the cylinder block and which converts the rotary movement of the swash plate to the reciprocal movement of the piston, and to a method for manufacturing a shoe of this type.

BACKGROUND ART

A swash plate type compressor shoe has a swash plate which is rotated by a rotating shaft in a cylinder block and a piston which is slidably fitted inside the cylinder block. Conventionally, in order to convert the rotary movement of the swash plate to the reciprocal movement of the piston, a shoe with a hemispherical recess is brought into slidable contact with the swash plate, and a ball is interposed in the hemispherical recess between the shoe and the swash plate. However, when both the shoe and the ball are used, the assembly procedure becomes complex. In addition to this, since the shoe and the ball are in slidable contact with each other and the ball and the piston are also in slidable contact with each other, much power is consumed by friction between these members. It is also difficult to make the overall length small in the axial direction of the shoe and the ball, resulting in a great length of the cylinder block in the axial direction. A compact swash plate type compressor has therefore been difficult to manufacture.

It is therefore an object of the present invention to provide a swash plate type compressor shoe wherein the assembly procedure is simple, the power loss due to friction is reduced to the minimum, and the axial length of the cylinder block is shortened so that the compressor may be compact in size.

It is another object of the present invention to provide a method for manufacturing by plastic deformation, a shoe of the type as described above, which does not require a shoe element of good precision conforming to the shape of a press die and which still guarantees a shoe of excellent shape.

It is still another object of the present invention to provide a method for manufacturing a shoe of the type described above, which allows a uniform load to act upon the shoe element and reduces the flow of the material during the plastic deformation, and which allows smooth processing.

DISCLOSURE OF INVENTION

The present invention is characterized in that a hemispherical part is formed in a shoe, and this hemispherical part is directly brought into slidable contact with a hemispherical recess of the piston without incorporating a ball. By forming a hemispherical part on the shoe itself and bringing it into slidable contact with the hemispherical recess of the piston, the assembly of the swash plate type compressor becomes easy, the power consumption is reduced, and the overall length of the compressor is shortened.

According to an aspect of the method of the present invention, for compressing a columnar element in its axial direction for causing plastic deformation, one end of the columnar element is subjected to plastic deformation at the inner surface of the hemispherical recess of a die while the other end of it is urged against a flat end face of another die, so that a flank part may be formed between the hemispherical part slidably contacting the hemispherical recess of the piston and the bottom end face which is in slidable contact with the swash plate.

According to another aspect of the method of the present invention, a hole of a predetermined size is formed at the end face of the columnar element as the shoe element, and the opening side of the hole is reduced in diameter by pressing the periphery of the end face, thereby forming a hemispherical part having an opening at the top.

According to still another aspect of the method of the present invention, the periphery of the end face of the columnar element is cut into a conical shape, and this conical part is pressed into a hemispherical shape. According to this method of the present invention, the load acting upon the element may be made uniform, the flow of the material may be reduced, and the formation may be performed smoothly.

BEST MODE OF CARRYING OUT THE INVENTION

Figure 1:
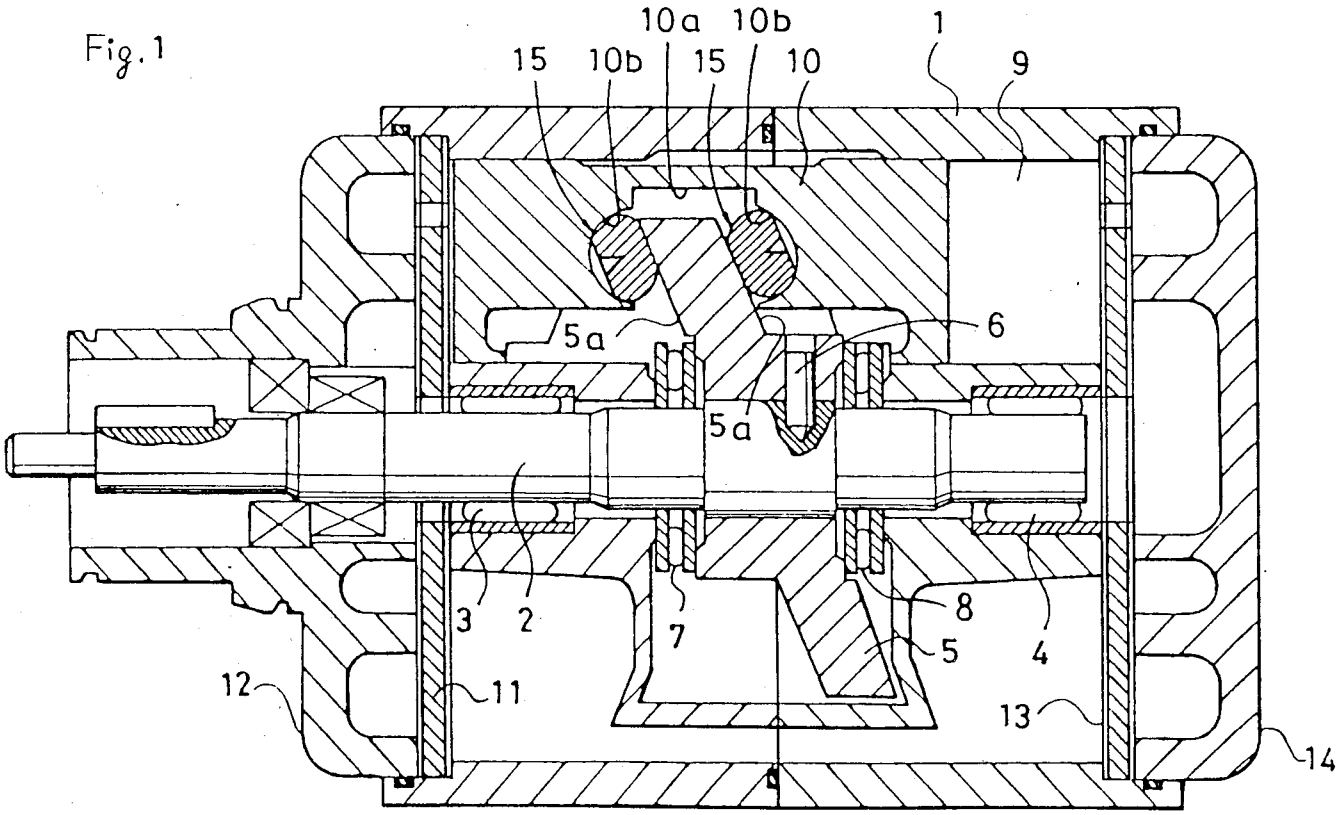
FIG. 1 is a longitudinal sectional view of a swash plate type compressor incorporating a shoe according to an embodiment of the present invention.

The embodiments of the present invention will now be described with reference to the accompanying drawings. Referring to FIG. 1, a rotating shaft 2 is rotatably supported by bearings 3 and 4 inside a cylinder block 1. A swash plate 5 is fixed to the rotating shaft 2 by a pin 6. Thrust bearings 7 and 8 are respectively interposed between the two ends of the swash plate 5 and the cylinder block 1. The cylinder block 1 has cylinder bores 9 arranged equiangularly, generally every 120°, into which are slidably fitted pistons 10. The left end opening of the cylinder block 1 is closed with a valve plate 11 and a front cylinder head 12, and the right end opening thereof is closed with a valve plate 13 and a rear cylinder head 14.

A recess 10*a* for receiving the outer periphery of the swash plate 5 is formed at the central portion of the piston 10. Hemispherical recesses 10*b* are formed at the inner opposing side surfaces of the recess 10*a*. Shoes 15 of the present invention are interposed between the respective hemispherical recesses 10*b* and end faces 5*a* of the swash plate 5.

Figure 2:
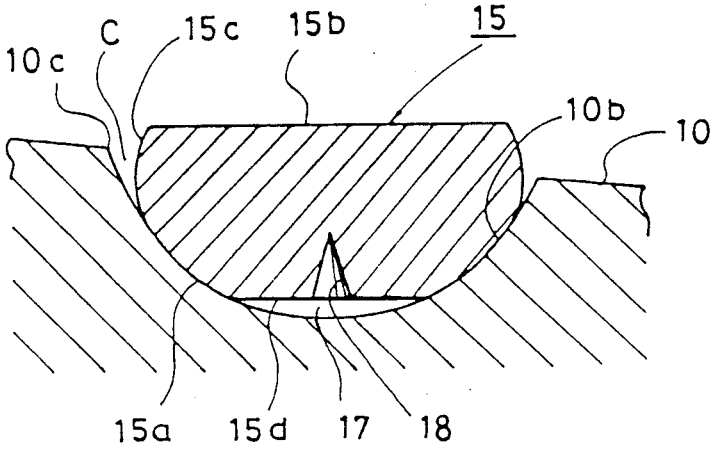
FIG. 2 is an enlarged view of the shoe shown in FIG. 1.

The shoe 15 of the present embodiment comprises a single member of a single material such as an alloy of Fe, Cu or Al. As shown in FIG. 2, the shoe 15 has a hemispherical part 15*a* which engages with the hemispherical recess 10*b* of the piston 10 for slidable contact therewith, a flat bottom end face 15*b*, and a flank 15*c* which is positioned between the hemispherical part 15*a* and the bottom end face 15*b*. The bottom end face 15*b* is in slidable contact with the end face 5*a* of the swash plate 5. The cross-sectional area in the flank 15*c* is gradually reduced from the hemispherical part 15*a* toward the bottom end face 15*b*. The flank 15*c* and the hemispherical recess 10*b* of the opposing piston 10 thus define a clearance c. Under the condition that the shoe 15 is not reciprocating, the flank 15*c* begins at a place about $\frac{1}{3}$ the depth of the hemispherical recess 10*b* from the opening of the hemispherical recess 10*b*. The flank 15*c* has a curvature corresponding to 60 to 90% of the maximum diameter of the shoe 15 up to the bottom end face 15*b*. This flank 15*c* is formed in the shoe 15 for the purpose of facilitating the supply of lubricant to the engaging surfaces of the piston 10 and the shoe 15 through the clearance c, reducing the abrasion between these two members, and stabilizing the operation of the piston 10 by preventing hooking of the shoe 15 at an edge 10*c* of the hemispherical recess 10*b* of the piston 10.

A top 15*d* of the hemispherical part 15*a* is formed flat, defining an inner cavity 17 with the hemispherical recess 10*b* of the piston 10. This inner cavity 17 serves to hold the lubricant or any foreign material. A conical hole 18 is formed at the top 15*d* to serve as a lubricant reservoir or grease sealing hole.

With the shoe 15 of the construction as described above, the assembly becomes easier as compared with the conventional compressor which utilizes a shoe and a ball. Furthermore, since the members are in slidable contact at two different places, i.e., between the swash plate 5 and the shoe 15 and between the shoe 15 and the piston 10, and the power consumption caused by friction may be reduced. Furthermore, since the axial length of the shoe 15, that is, the space between the end face 5*a* of the swash plate 5 and the hemispherical recess 10*b* of the piston 10 may be reduced, the axial length of the swash plate type compressor may be shortened. In addition, since the clearance c is provided between the piston 10 and the shoe 15, the lubricant enters between the engaging surfaces of these members, so that the sliding conditions are improved and the shoe 15 may not hook the piston 10.

Figure 9:
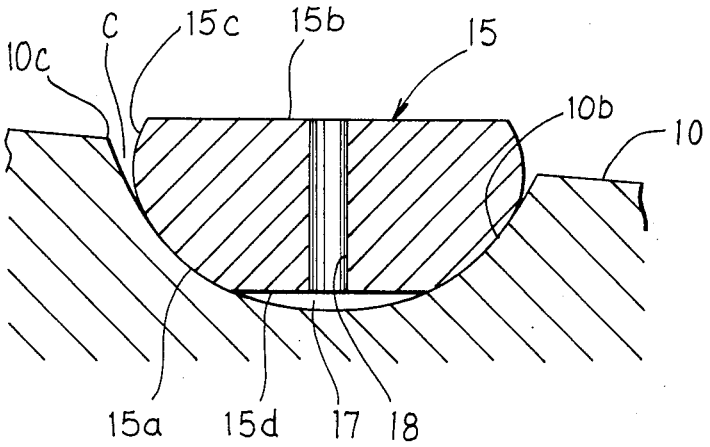
FIG. 9 is a view similar to FIG. 2 but showing a modification involving a through hole.

With the shoe 15 having the flat face 15*d*, the cavity 17 is formed with the hemispherical recess 10*b* when the hemispherical part 15*a* is brought into slidable contact with the hemispherical recess 10*b* of the piston 10. This cavity 17 serves as a lubricant reservoir as in the case of the hole 18. When powder is formed due to abrasion of the hemispherical part 15*a* and the hemispherical recess 10*b*, the cavity 17 serves to accomodate this powder, and adverse effects of the powder from abrasion, that is, increase of wearing, may be prevented more than in the case of the conventional shoe which does not have the cavity 17. The flat face 15*d* of the shoe 15 need not be flat, but may be convex or preferably be concave, as long as the cavity 17 is formed. The extreme example of the recess is the hole 18. The flat face 15*d* may thus have a through hole opening to the side of the bottom end face 15*b* (as in FIG. 9), or may have a columnar or hemispherical hole or a combination thereof.

Figure 3:
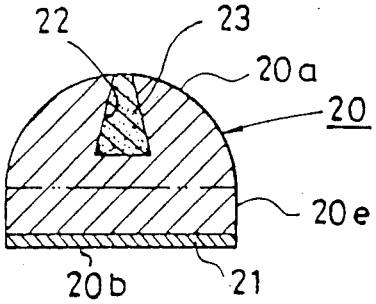
FIGS. 3 to 5 are enlarged sectional views showing shoes according to other embodiments of the present invention.

The shoe according to another embodiment of the present invention will now be described with reference to FIG. 3. Referring to FIG. 3, a shoe 20 according to this embodiment has a hemispherical part 20*a* which engages with the hemispherical recess 10*b* of the piston 10 for slidable contact therewith, a columnar part 20*e* contiguous with the hemispherical part 20*a*, and a backing metal 21 formed integrally at the bottom surface of this columnar part 20*e*. A bottom end face 20*b* of this backing metal 21 is brought into slidable contact with the end face 5*a* of the swash plate 5. A hole 22 with a bottom and opening to the top of the hemispherical part 20*a* is formed in the shoe 20. The hole 22 has a reduced inner diameter toward the opening side. A filling material 23 such as felt, which is capable of absorbing the lubricant, is filled in the hole 22. As the diameter of the hole 22 is reduced toward the opening side, the hole 22 securely holds the filling material 23. The material of the hemispherical part 20*a* is preferably Fe or an Fe alloy. The material of the backing metal 21 is preferably a Cu-Pb-Sn alloy and, more preferably, a sintered body of the Cu-Pb-Sn alloy.

Figure 4:
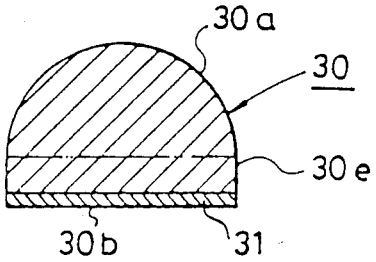
Figure 5:
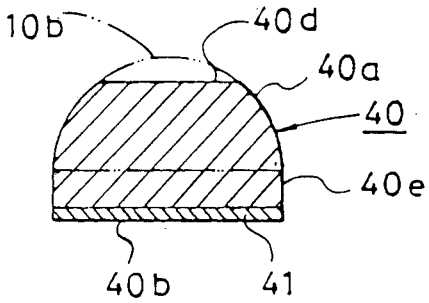

FIGS. 4 and 5 show still other embodiments of the present invention. In a shoe 30 shown in FIG. 4, the hole 22 and the filling material 23 are omitted from the shoe 20 shown in FIG. 3, and the top of a hemispherical part 30*a* is completely hemispherical. In a shoe 40 shown in FIG. 5, a flat surface 40*d* is formed at the top of a hemispherical part 40*a* in the shoe 30 shown in FIG. 4. Both these shoes 30 and 40, as in the case of the shoe 20 shown in FIG. 3, have columnar parts 30*e* and 40*e* and backing metals 31 and 41. Bottom end faces 30*b* and 40*b* of the backing metals 31 and 41 are brought into slidable contact with the end face 5*a* of the swash plate 5.

With the shoes 20, 30 and 40 shown in FIGS. 3 to 5, as in the case of the shoe 15 shown in FIG. 2, the assembly procedure is simplified, the consumption of power is reduced to the minimum, and the compressor may be made compact in size as compared with the conventional compressor using shoes and balls. In these shoes 20, 30 and 40, the backing metals 21, 31 and 41 may be omitted as in the case of the shoe 15. Alternatively, the shoe 15 may comprise a bimetal structure with a backing metal.

Figure 6:
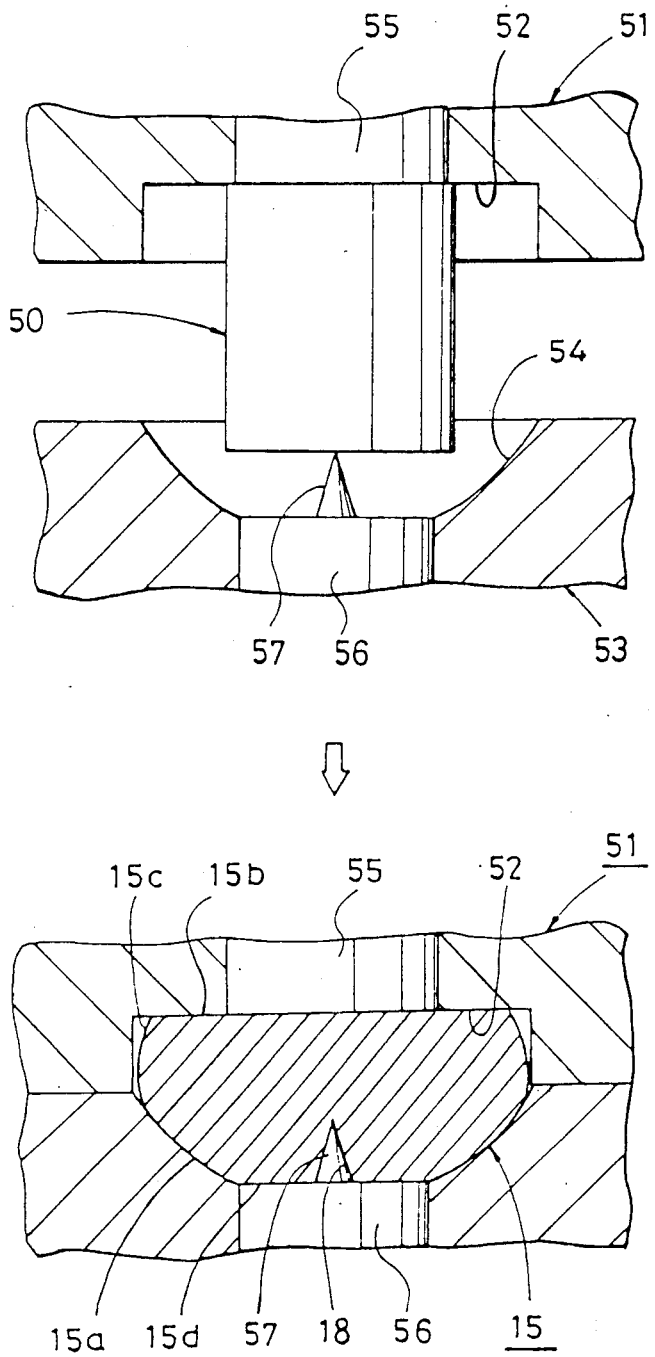
FIG. 6 shows the manufacturing procedure of the shoe shown in FIG. 2 according to an embodiment of the method of the present invention.

The method for manufacturing the shoe 15 shown in FIG. 2 will now be described. Referring to FIG. 6, an element 50 is obtained by cutting a rod material of a diameter which is about $\frac{2}{3}$ the maximum diameter of the shoe 15 in such a manner that the cut rod element may have about the same weight as the shoe 15 to be manufactured. The element 50 has an elongate, columnar shape. This element 50 is placed between a columnar recess 52 of an upper die 51 of a press and a hemispherical recess 54 of a lower die 53. The upper die 51 has a columnar die 55 which has a diameter equal to that of the element 50 at the center of the columnar recess 52 and which is free to move vertically. The lower end face of the die 55 is roughened by knurling. During pressing, the die 55 is held at substantially the same level as the surface of the columnar recess 52 to be lowered together with the upper die 51, and the rough surface at the lower end face of the die 55 supports the lower end face of the element 50 so as to prevent transverse shifting of the element 50.

The lower die 53 also has a columnar die 56 of a diameter substantially the same as that of the element 50 at the center of the hemispherical recess 54. This die 56 has a conical projection 57 at the upper end face for positioning. This die 56 is supported during pressing so that the periphery at the upper end of the die 56 may be substantially even with the surface of the hemispherical recess 54.

The element 50 is initially arranged between the dies 55 and 56 to be coaxial therewith. When the upper end face of the element 50 contacts the lower end face of the die 55 and the lower end face of the element 50 contacts the front end of the projection 57, the element 50 is firmly held. Then, the upper die 51 and the die 55 are lowered toward the lower die 53 and the die 56 to compress the element 50 in the axial direction.

The pressing operation is completed when the upper die 51 contacts the lower die 53. In this manner, the element 50 is formed into the shoe 15 by plastic deformation. The hemispherical part 15*a* is formed by the surface of the hemispherical recess 54, the flat face 15*d* is formed by the upper end face of the die 56, and the hole 18 is formed by the projection 57. The depth of the recess 52 is so set that the diameter of the shoe 15 at the side of the bottom end face 15*b* becomes greater than the diameter at the upper end of the element 50 but smaller than that of the columnar recess 52. Due to this setting of the depth of the recess 52, the flank 15*c* is automatically formed at the side of the bottom end face 15*b*. The part of the element 50 corresponding to the flank 15*c* is radially expanded when the upper end face of the element 50 is pressed against the lower end face of the die 55, under the condition that this flank part is at a distance from the inner circumferential surface of the columnar recess 52. Therefore, the flank 15*c* is formed in the element 50 in such a manner that the diameter of the shoe is enlarged from the side of the bottom end face 15*b* toward the side of the hemispherical part 15*a*.

As a result of this, the size of the dies 51 and 53, particularly the columnar recess 52 of the upper die 51, need not be set very precisely, and small variations in the volume of the element 50 do not present a big problem.

The flank 15*c* may be forcibly formed with another desired shape if the recess 52 conforms to the desired shape of the flank 15*c* instead of the columnar shape.

When the upper die 51 is pressed against the lower die 53 to complete the forming operation, the shoe 15 is released from these upper and lower dies 51 and 53. The bottom end face 15*b* of the shoe 15 is then smoothed. The shoe 15 is then subjected to surface treatments such as carburizing, nitriding, quenching, sulphurizing, boronizing, hard Cr plating, Ni-P plating, Cu plating or the like for the purpose of improving the abrasion resistance. According to one of the most preferable surface treatments, the shoe is degreased in a solution of alkali such as caustic soda at 60° to 70° C., washed with cool water, and washed with hot water to remove the alkali component attached to the surface.

The shoe is then immersed in a manganese phosphate aqueous solution at 85° to 95° C., or subjected to soft nitriding to form a primary coat on the surface of the shoe. If a film of manganese phosphate is formed as the primary coat, addition of an accelerator to the solution of manganese phosphate serves to shorten the processing time. The primary coat can be omitted, if desired.

After the shoe is washed with hot water and dried with warm air, a lubricant coat is formed over the primary coat. The lubricant coat 19 consists of a mixture of a base material of a low-friction synthetic resin such as a fluorine resin, a phenol resin or an epoxy resin, with a tetrafluoroethylene polymer, molybdenum disulfide, tungsten disulfide, graphite, boron nitride or mixtures thereof. The mixture is applied by tumbling, spraying, immersion, or brushing to form the lubricant coat. More specifically, after the primary coat is rinsed with hot water and dried with warm air, a mixture of one of the composition Nos. 1-4 shown in Table 1 below is applied thereover to form a coat. The coat is baked at 180° C. for 30 minutes or at 150° C. for 1 hour.

TABLE 1

| No. | Lubricant Coat Composition | Add. Amt. (w/o) | Film Thickness (μm) |
|---|---|---|---|
| 1 | Phenol resin | 60 | About 1.5 |
| | Graphite | 20 | |
| | Molybdenum disulfide | 20 | |
| 2 | Epoxy resin | 40 | About 5 |
| | Molybdenum disulfide | 40 | |
| | Tetrafluoroethylene polymer $[(CF_2—CF_2)_n]$ | 20 | |
| 3 | Epoxy resin | 30 | About 8 |
| | Molybdenum disulfide | 20 | |
| | Boron nitride | 10 | |
| | Graphite | 20 | |
| | Tetrafluoroethylene polymer $[(CF_2—CF_2)_n]$ | 20 | |
| 4 | Phenol resin | 40 | About 7 |
| | Molybdenum disulfide | 30 | |
| | Graphite | 20 | |
| | Tetrafluoroethylene polymer $[(CF_2—CF_2)_n]$ | 10 | |

By coating the surface of the shoe with a low friction material laminate consisting of a primary coat of a manganese phosphate conversion coating or a soft nitrided film of a thickness of about 3 μm and a lubricant coat formed thereover, the conformability and resistance to cohesiveness of the shoe with the swash plate 5 made of DCI or the piston 10 are improved, and the friction characteristics of the shoe are improved. This improvement is especially notable in the case of boundary lubrication.

Figure 7:
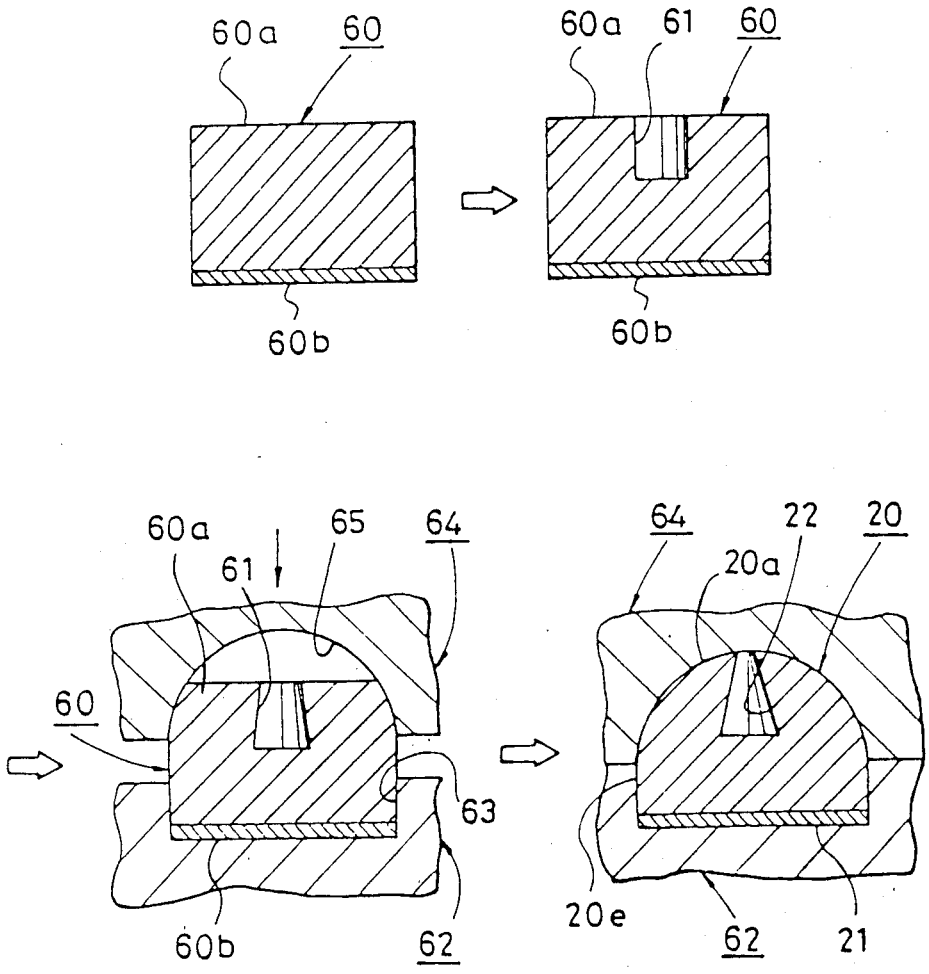
FIGS. 7 and 8 show the manufacturing procedure of the shoes shown in FIGS. 3 and 4, respectively, according to other embodiments of the present invention.

The method for manufacturing the shoe 20 shown in FIG. 3 will now be described. Referring to FIG. 7, a columnar element 60 has predetermined height and width. This element 60 is punched out of a sheet of a bimetal (not shown) of the predetermined thickness. A major part 60*a* of the element 60, that is, the part of the element 60 which becomes the hemispherical part 20*a* and the columnar part 20*e* after processing, may be made of an Fe alloy. A backing metal 60*b* may be made of a Cu alloy, in particular, a Cu-Pb-Sn alloy or an Al alloy. When this element 60 is obtained, a hole 61 with a bottom which has predetermined inner diameter and depth is formed at the center of the end face of the major part 60*a*. Next, the element 60 is dropped inside a columnar recess 63 of a lower die 62 of a press, with the backing metal 60*b* facing downward. This columnar recess 63 has the inner diameter which is equal to the diameter of the element 60 and a depth which is equal to the total height of the columnar part 20*e* and the backing metal 21. An upper die 64 paired with the lower die 62 has a hemispherical recess 65, the surface of which conforms to the outer surface of the hemispherical part 20*a* to be formed.

After the element 60 is dropped inside the recess 63 and the axes of the recesses 63 and 65 are aligned, the upper die 64 is moved downward. The periphery of the upper end face of the element 60 then first contacts the inner surface of the hemispherical recess 65. When the upper die 64 is moved downward further, this part is deformed inward along the radial direction of the element 60 and the opening side of the hole 61 is reduced in diameter as compared with the bottom side thereof. When the upper die 64 is further moved downward to contact the lower die 62, the formation of the shoe 20 is completed.

During the manufacture of the shoe 20, the upper end face of the element 60 need not be deformed up to the inner periphery adjacent to the opening side of the hole 61. The inner periphery, therefore, need not contact the inner surface of the hemispherical recess 65, that is, the inner surface of the hemispherical recess 10*b* of the piston 10. For charging the filling material 23, it may be filled inside the hole 22 before or after formation of the shoe 20. It is also possible to completely close the opening side of the hole 61 by this formation.

When the upper die 64 is urged toward the lower die 62 to complete the formation of the shoe 20, the shoe 20 is released from the upper and lower dies 64 and 62. The surface of the hemispherical part 20*a* is subjected to the surface treatments as described above for the purpose of improving the abrasion resistance, thereby completing the manufacture of the shoe 20.

Since the hole 61 is formed in the element 60 according to the method described above, the flow of the material may be reduced and smooth formation may be facilitated by reducing the inner diameter of the hole 61 during the press deformation of the major part 60*a*. When the flow of the material is great, especially when the material is a Cu-Pb alloy or an Al-Sn alloy, the matrix is superposed on the soft metal such as Pb or Sn having sliding property, thereby impairing the sliding property. This problem is solved with the hole 61. If the hole 61 is not formed in the hemispherical part, the pressure acting on the center of the backing metal 60*b* becomes less than that acting on the outer periphery thereof. Therefore, the thickness at the outer periphery becomes smaller than at the center of the backing metal 60*b*. When a shoe with such a backing metal is assembled in a swash plate type compressor, the backing metal 60*b* tends to be peeled off. However, if the hole 61 is formed, the pressure acting on the backing metal 60*b* may be made uniform so that the problem as described above may be prevented.

The hole 61 to be formed in the element 60 may therefore take any shape if it serves to achieve the object as described above. For example, for charging the filling material 23, the hole 61 is preferably a columnar hole with a bottom and preferably opens to the end face of the element even after the formation. However, this hole 61 may alternatively be a through hole which opens also at the backing metal 60*b* of the element 60, and may take a shape such as a conical shape, a spheroidal shape, or a combination of a columnar shape therewith.

Figure 8:
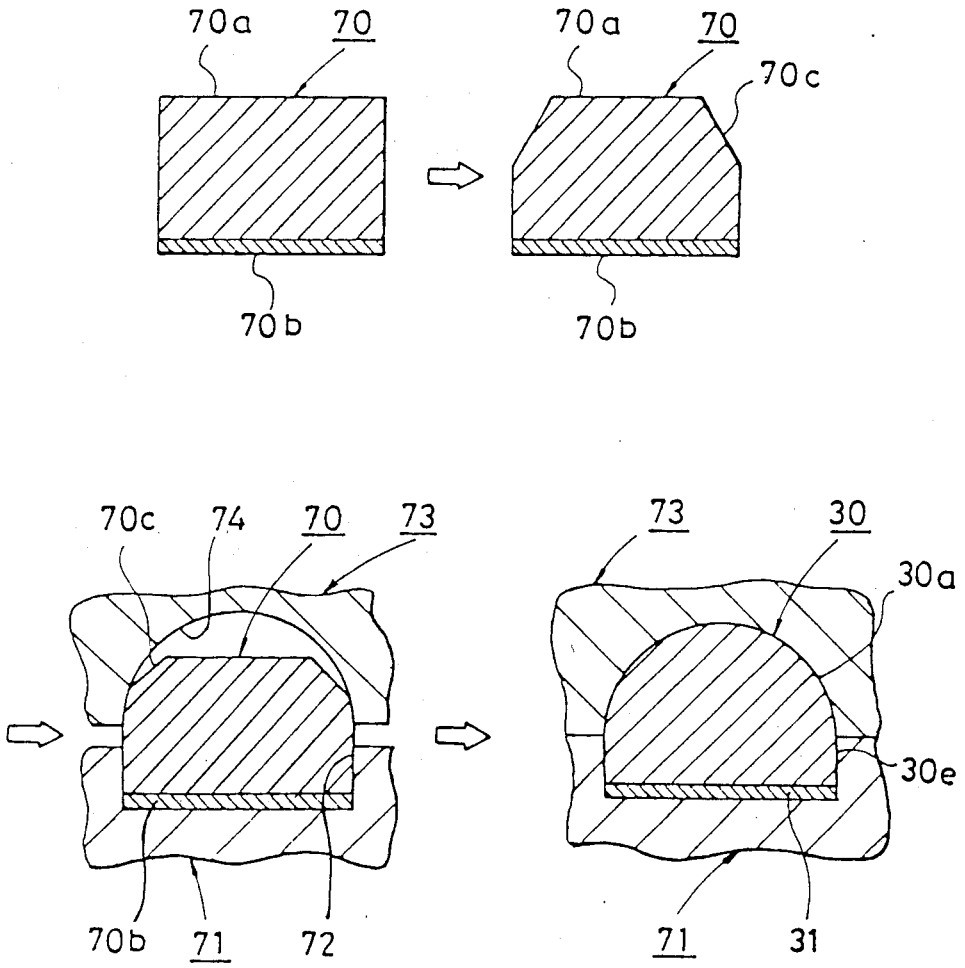

FIG. 8 shows another embodiment of the method according to the present invention. This embodiment is suitable for manufacturing the shoe 50 shown in FIG. 4. Referring to FIG. 8, a columnar element 70 has predetermined height and diameter. This element 70 is punched from a sheet of a bimetal material (not shown) of the predetermined thickness. A major part 70*a* of the element 70, that is, the part of the element 70 which becomes the hemispherical part 30*a* and the columnar part 30*e* after processing, may be made of an Fe alloy. A backing metal 70*b* may be made of a Cu alloy, in particular, a Cu-Pb-Sn alloy or an Al alloy. When this element 70 is obtained, a conical part 70*c* of a predetermined size is formed at the periphery of the end face of the major part 70*a*. Next, the element 70 is dropped inside a columnar recess 72 of a lower die 71 of a press, with the backing metal 70*b* facing downward. This columnar recess 72 has an inner diameter which is equal to the diametr of the element 70 and a depth which is equal to the total height of the columnar part 30*e* and the backing metal 31. An upper die 73 paired with the lower die 71 has a hemispherical recess 74, the surface of which conforms to the outer surface of the hemispherical part 30*a* to be formed.

After the element 70 is dropped inside the recess 72 and the axes of the recesses 72 and 74 are aligned, the upper die 73 is moved downward. The periphery of the upper end face of the element 70 then first contacts the inner surface of the hemispherical recess 74. When the upper die 73 is moved downward further, this part is deformed inward along the radial direction of the element 70. When the upper die 73 is further moved donward to contact the lower die 71, the formation of the shoe 30 is completed. Then, the shoe 30 is released from the upper and lower dies 73 and 71. The surface of the hemispherical part 30*a* is subjected to the surface treatments as described above for the purpose of improving the abrasion resistance.

Since the conical part 70*c* is formed prior to the pressing of the element 70 in the method according to this embodiment, exertion of a local high load on the element 70 during the pressing of the major part 70*a* thereof may be prevented. Furthermore, by reducing the flow of the material, the pressing may be performed smoothly.

When the shoe has the columnar part 20*e* contiguous with the hemispherical part 20*a* as in the shoe 20 shown in FIG. 3, the columnar part 20*e* may have a diameter greater than that of the hemispherical part 20*a*, or it may have a different shape. In other words, the element need not be columnar, but must only have a columnar portion for forming the hemispherical part 20*a*. The columnar part 20*e* may be omitted as needed.

We claim:

1. A swash plate type compressor shoe which is interposed between a swash plate rotated by a rotating shaft inside a cylinder block and a piston which is slidably fitted inside a cylinder bore and which converts rotary movement of said swash plate to reciprocal movement of said piston, wherein said shoe has a hemispherical part and a flat bottom end face, said bottom end face is in slidable contact with an end face of said swash plate, and a surface of said hemispherical part is in slidable contact with a surface of said piston forming a hemispherical recess, wherein said shoe has a curved flank between said hemispherical part and said bottom end face which is gradually reduced in cross-sectional area from said hemispherical part toward said bottom end face, defining a clearance between said flank and an opposing part of said hemispherical recess.

2. A shoe according to claim 1, wherein said top of said hemispherical part of said shoe is flat.

3. A shoe according to claim 1, wherein said shoe is made of a single member of a single material.

4. A shoe according to claim 3, wherein said shoe is made of an alloy of Fe, Cu or Al.

5. A shoe according to claim 1, wherein a recess is formed in said top of said hemispherical part of said shoe.

6. A shoe according to claim 5, wherein said recess is a hole.

7. A shoe according to claim 1, wherein a lubricant coat of low-friction synthetic resin is formed on at least a surface of said hemispherical part of said shoe.

8. A shoe according to claim 7, wherein said low-friction synthetic resin is a mixture of a base material selected from the group consisting of a fluorine resin, a phenol resin and an epoxy resin, with a member selected from the group consisting of a tetrafluoroethylene polymer, molybdenum disulfide, tungsten disulfide, graphite, boron nitride and mixtures thereof.

9. A shoe according to claim 7, including a primary coat comprising a manganese phosphate conversion coating or a soft nitrided film at least one said surface of said hemispherical part of said shoe, and a lubricant coat thereover.

10. A swash plate type compressor shoe which is interposed between a swash plate rotated by a rotating shaft inside a cylinder block and a piston which is slidably fitted inside a cylinder bore and which converts rotary movement of said swash plate to reciprocal movement of said piston, wherein said shoe has a hemispherical part and a flat bottom end face, said bottom end face is in slidable contact with an end face of said swash plate, and a surface of said hemispherical part is in slidable contact with a surface of said piston forming a hemispherical recess, wherein a top of said hemispherical part of said shoe does not contact the surface forming said hemispherical recess of said piston, thereby defining a clearance therebetween, a hole being formed in said top of said hemispherical part of said shoe, wherein said hole is a hole with a bottom.

11. A shoe according to claim 10, wherein a diameter of said hole is greater at a bottom thereof than at an opening side thereof.

12. A swash plate type compressor shoe which is interposed between a swash plate rotated by a rotating shaft inside a cylinder block and a piston which is slidably fitted inside a cylinder bore and which converts rotary movement of said swash plate to reciprocal movement of said piston, wherein said shoe has a hemispherical part and a flat bottom end face, said bottom end face is in slidable contact with an end face of said swash plate, and a surface of said hemispherical part is in slidable contact with a surface of said piston forming a hemispherical recess, wherein a top of said hemispherical part of said shoe does not contact the surface forming said hemispherical recess of said piston, thereby defining a clearance therebetween, a hole being formed in said top of said hemispherical part of said shoe, wherein said hole is charged with grease or with a filling material which is capable of absorbing a lubricant.

13. A swash plate type compressor shoe which is interposed between a swash plate rotated by a rotating shaft inside a cylinder block and a piston which is slidably fitted inside a cylinder bore and which converts rotary movement of said swash plate to reciprocal movement of said piston, wherein said shoe has a hemispherical part and a flat bottom end face, said bottom end face is in slidable contact with an end face of said swash plate, and a surface of said hemispherical part is in slidable contact with a surface of said piston forming a hemispherical recess, wherein a top of said hemispherical part of said shoe does not contact the surface forming said hemispherical recess of said piston, thereby defining a clearance therebetween, a hole being formed in said top of said hemispherical part of said shoe, wherein said hole is a through hole which opens to said bottom end face.

* * * * *